United States Patent [19]

Hill

[11] Patent Number: 4,672,628

[45] Date of Patent: Jun. 9, 1987

[54] ASSEMBLY FOR THE AUTOMATIC COOLING WATER CONNECTION TO WATER-COOLED COMBINATION ELECTRODES FOR ELECTRIC ARC FURNACES

[75] Inventor: Dereck Hill, Hadfield, United Kingdom

[73] Assignee: Arc Technologies Systems Ltd., Georgetown, Cayman Islands

[21] Appl. No.: 747,139

[22] Filed: Jun. 20, 1985

[30] Foreign Application Priority Data

Jun. 25, 1984 [EP] European Pat. Off. ..... 84810313.1

[51] Int. Cl.[4] ..... H05B 7/101

[52] U.S. Cl. ..... 373/93; 373/90; 373/94

[58] Field of Search ..... 373/91, 92, 93, 94, 373/99, 101, 103, 90, 100

[56] References Cited

U.S. PATENT DOCUMENTS 4,170,712 10/1979 Elsner ..... 373/103

4,453,254 6/1984 Ehle et al. ..... 373/93

4,468,783 8/1984 Bauer et al. ..... 373/93

4,601,042 7/1986 Reynolds et al. ..... 373/93

*Primary Examiner*—Roy N. Envall, Jr.

*Attorney, Agent, or Firm*—Frost & Jacobs

[57] ABSTRACT

An automatic facility for the connection of combination arc electrodes to a cooling water circuit, comprising a cooling water coupling device (17) mounted on the supporting arm (3) of the electrode, which on the one hand is connected to cooling water ducts (15, 15') and which on the other hand has openings (19, 19', 19'') into which the free ends (21, 21') of cooling water guides (7,8) may be inserted, which are connected to the heat exchanger (1) of the combination electrode. By means of a fixing device (11, 11') mounted e.g. on the ring flange (9) of a contact device which is axially movable on the electrode, these ends of the cooling water guides may be positioned in such a way that, when slipping the electrode down through the clamping device (4) of the supporting arm (3) of the electrode, the free ends (21, 21') automatically assume an angle orientation which makes it possible to neatly insert these ends into the openings (19, 19') of the cooling water coupling device (17).

9 Claims, 12 Drawing Figures

ASSEMBLY FOR THE AUTOMATIC COOLING WATER CONNECTION TO WATER-COOLED COMBINATION ELECTRODES FOR ELECTRIC ARC FURNACES

FIELD OF THE INVENTION

The invention relates to an assembly for the automatic cooling water connection to water-cooled combination electrodes for electric arc furnaces, comprising a combination electrode which has an essentially cylindrical heat exchanger and a consumable electrode connected to said heat exchanger by means of a nipple, with the combination electrode being fixed in an electrode supporting arm having an electrode clamping device at any clamping position within a clamping zone covering part of the heat exchanger with the heat exchanger having cooling water supply and cooling water discharge connections.

BACKGROUND OF THE INVENTION

In general, water-cooled combination electrodes comprise a heat exchanger and a graphite electrode affixed to said heat exchanger by means of a threaded nipple, with the heat exchanger and the graphite electrode each being cylindrically shaped and aligned in nippled condition. The heat exchanger is connected to a cooling water system by means of cooling water guides and has to be disconnected from the same when the electrodes are replaced. During the replacement of electrodes, which is necessary when new, unconsumed graphite electrodes are mounted by means of threaded nipples, the combination electrode is disconnected from the water circuit until it can again be connected to another water circuit in the nippling jig. The period available for this process is relatively short, as the water inside the heat exchanger is growing warm.

It is desirable therefore, to keep the period between the disconnection of the cooling water supply from the electrode on the electric arc furnace in the operating position, and its reconnection, with the electrode in the nippling jig, as short as possible. As the period during which the electrode is transported from the electric arc furnace to the nippling jig is determined by the manipulation time of the crane, it is only the disconnecting and reconnecting of the cooling water ducts that can be optimized. One possibility to shorten the period required for these operations is to automate the disconnection and reconnection of the water ducts.

As the manual connection and disconnection operations have to be carried out above the electric arc furnace, an automation of this process is desirable also from the viewpoint of industrial safety.

OBJECT OF THE INVENTION

Therefore, the object of the present invention is to provide an automatic water connection assembly for combination electrodes which is designed to shorten the electrode replacement periods during which the electrodes are disconnected from the cooling water circuit. Another object of the invention is to increase safety at the working place. Furthermore, the water coupling facility to be suggested should be reliable and available at a favorable price.

SUMMARY OF THE INVENTION

These problems are solved by the type of assembly as described in the preamble, which is further characterized in that it comprises a fixing device movable axially to the heat exchanger along the clamping zone, for the free ends of flexible cooling water guides whose other ends are connected to cooling water supply and cooling water discharge connections, and a cooling water coupling device affixed to the electrode support arm, which, by means of a movement having an axial and, occasionally, circumferential component, of the free ends of the cooling water guides may be connected to said water guides, and that the electrode clamping device has guide means which, along with the guide laps of a ring flange, act in such a way that, on lowering the ring flange onto the electrode clamping device, the free ends, at the latest at an axial height shortly before their insertion into the openings, assume an angular orientation in which they are exactly aligned with the openings.

The indicated fixing device may be mounted on a ring surrounding the heat exchanger which is axially movable on the heat exchanger. If the electric arc electrode has a contact device surrounding the heat exchanger and axially movable along said heat exchanger, the fixing device may be mounted on a ring flange of the contact device.

The cooling water coupling device may have cooling water supply and discharge ducts which can be connected to the cooling water guides. For this purpose the cooling water coupling device may be designed in such a way that the cooling water guides can be inserted in a simple manner. For this reason the free ends of the cooling water guides may be directed parallel to the axis of the heat exchanger, as a result of which they are automatically inserted into the cooling water coupling device when the electrode is lowered into the arc furnace.

The cooling water coupling device may comprise a metal block having two openings running parallel to the axis of the heat exchanger, whose inside diameters are dimensioned in such a way that the free ends of the cooling water guides can easily be inserted in axial direction.

According to another embodiment of the invention, the free ends of the cooling water guides may lead radially away from the heat exchanger and be interconnected by means of a guide plate. The cooling water coupling device may have an opening having essentially the dimensions of the guide plate, whereby, when the combination electrode is slipped down through the electrode clamping device, it is possible to insert said guide plate into the opening of the cooling water coupling device in such a way that the free ends connected with the guide plate of the cooling water guides whose other ends are connected to the heat exchanger, are in alignment with the ends of the cooling water supply and discharge ducts which are connected to the cooling water coupling device.

To make the cooling water coupling device more reliable and to protect it against shocks, it may be mounted on the electrode support arm via shock absorbers.

The openings which take up the free ends of the cooling water guides and/or the opening which takes up the guide plate may have sealing devices which, after the connection of the respective parts, may be operated pneumatically or hydraulically, thereby sealing the water circuit against the outside.

DESCRIPTION OF THE DRAWINGS

The invention will be more readily understood in connection with the accompanying drawings in which FIGS. 1 to 5 show one embodiment of the invention, while

FIG. 1 is a side view of the assembly according to the invention.

FIG. 2 is a top view of the assembly according to FIG. 1.

FIG. 3 shows the cooling water coupling device shortly before the coupling operation.

FIG. 4 shows the same cooling water coupling device in the engaged condition.

FIG. 5 is a top view of the cooling water coupling device.

FIG. 6 shows a general view of the second embodiment of the assembly according to the invention.

FIG. 7 is a top view of the assembly according to FIG. 6.

FIG. 8 shows a cooling water coupling device according to FIGS. 6 and 7 shortly before the coupling process.

FIG. 9 shows the same cooling water coupling device after engagement.

FIG. 10 is a top view of the cooling water coupling device according to FIGS. 8 and 9.

FIG. 11 shows an enlarged detail of FIGS. 8, 9, and 10.

FIG. 12 shows a hydraulic sealing means for a cooling water coupling device according to FIGS. 6 to 10.

DETAILED DESCRIPTION OF THE DRAWINGS

Figure 1:
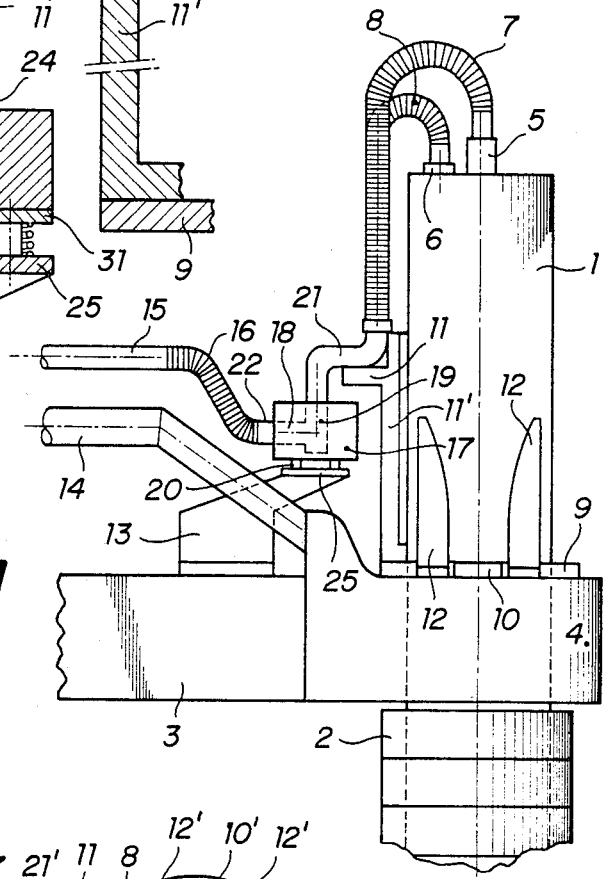
Figure 2:
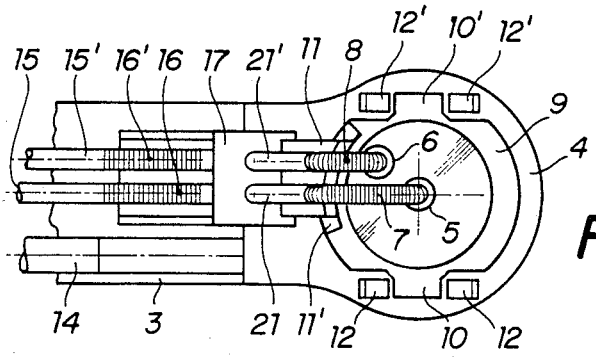

The devices illustrated in FIGS. 1 to 12 comprise individual components or component groups which are shown repeatedly and are referred to by the same reference number. FIGS. 1 and 2 show a heat exchanger 1 of a combination arc electrode, which is held in an electrode clamping device 4, which is part of an electrode support arm 3. The portion of the heat exchanger below the electrode clamping device 4 is surrounded by protective rings 2. Between the electrode clamping device and the heat exchanger there is a contact device of which only the ring flange 9 is visible. Said ring flange has two laps 10 and 10', which are located between two guide means 12 and 12'. At its upper end the heat exchanger 1 has a central cooling water supply connection 5 and an eccentric cooling water discharge connection 6, which are both connected to the cooling water coupling device 17 via flexible cooling water guides 7 and 8. The cooling water guides 7 and 8 have free ends 21, which are connected to a fixing device 11 and 11', which in turn is attached to the ring flange 9. The cooling water coupling device 17 is mounted on an assembly plate 25 via shock absorbers 20, said plate being affixed to the electrode support arm 3 via a support 13. The cooling water coupling device 17 has two openings 19, 19', which are located parallel to the axis of the heat exchanger 1, and two openings 18 leading radially away from the heat exchanger 1, with the free ends 21, 21' fitting into the opening 19, 19' and the ends 22 of the cooling water ducts 15, 15' into the openings 18. Flexible cooling water knee ducts 16, 16' are located between the rigid sections of the cooling water ducts 15, 15' and their ends 22. Reference number 14 is assigned to a busbar which provides the electric connection of the arc electrode.

Figure 3:
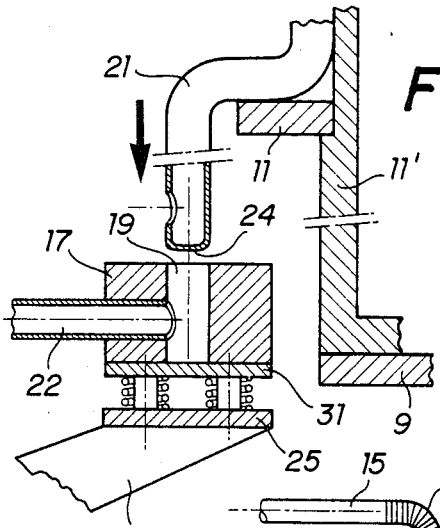
Figure 4:
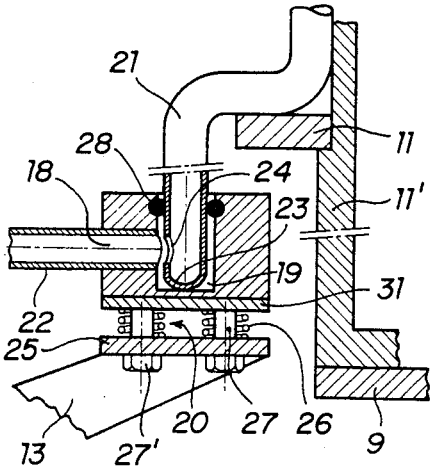

The operation of the assembly illustrated in FIGS. 1 and 2 is described in the following, with FIGS. 3 and 4 showing an enlargement of the parts reguired for the automatic cooling water coupling FIG. 3 shows the cooling water coupling device 17 in standby condition, with a free end 21 of the above mentioned cooling water guides waiting for its insertion into the opening 19. The free end 21 has previously been brought into an angular position upon lowering of the electrode by the action of guide means 12 as shown in FIG. 1, whereby it is aligned with the opening 19 at least shortly before its insertion therein. The free end 21 is closed with a round piece 23 at its front, and has an opening 24 on the side. In the engaged state shown in FIG. 4 this opening 24 approaches the end 22 of the cooling water duct, which results in an almost closed passage of the cooling water from end 22 to the free end 21. As this transition passage is not completely tight, there is an additional seal 28 consisting of an o'ring which is pressed hydraulically or pneumatically from the inside wall of the opening 19 against the free end 21.

The cooling water coupling device 17 has a bottom plate 31 comprising four bolts 27. Spiral springs 26 surround the bolts 27 co-axially, which permits the bottom plate 31 to be lowered against the force of the spiral springs 26. In this process, the bolts 27 pass through respective bores in the mounting plate 25, with said bores permitting the axial gliding of the bolts 27, but arresting the bolt heads 27'.

The free end 21 is supported by the fixing device 11, 11', which is mounted on the ring flange 9. The horizontal support 11 of the fixing device is located above the ring flange 9 at a height corresponding to about half the height of the clamping zone 38. In this way it is guaranteed that the same length of the cooling water guides 7 and 8 is required, no matter whether the heat exchanger is at its highest or lowest position in the clamping device, which means that if the clamping position is frequently changed within the clamping zone 38, there will be no danger of the cooling water guides 7 and 8 being stretched.

Figure 5:
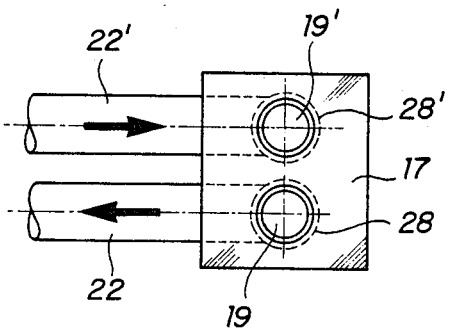
Figure 7:
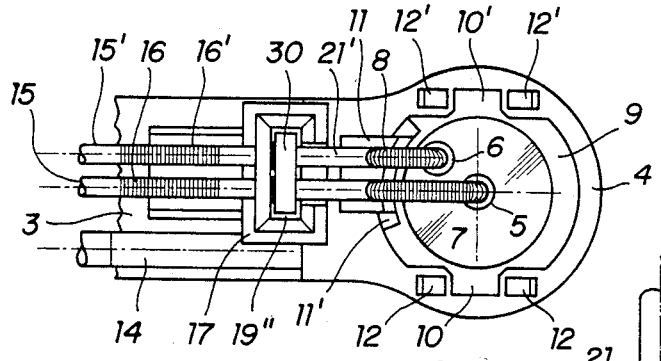
Figure 8:
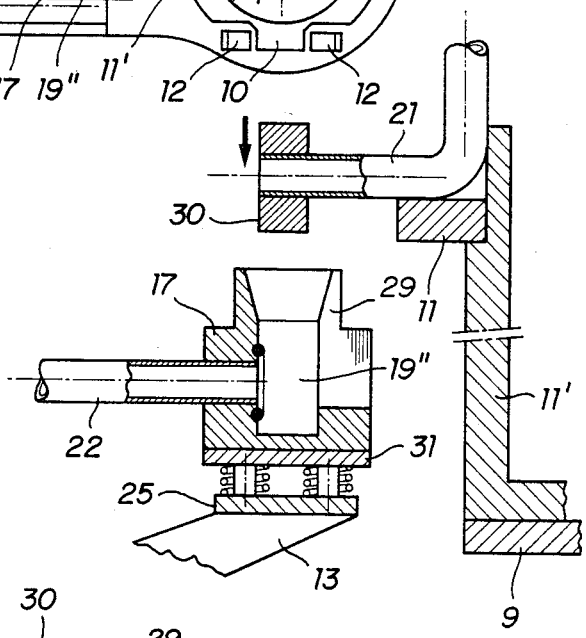
Figure 9:
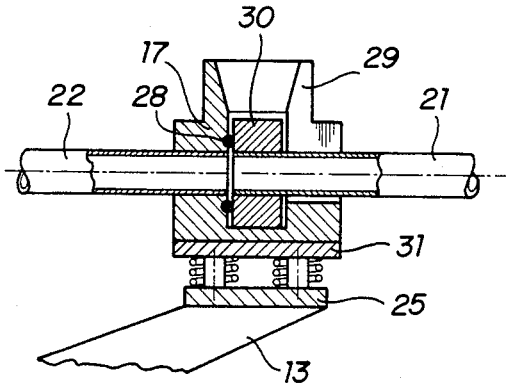
Figure 10:
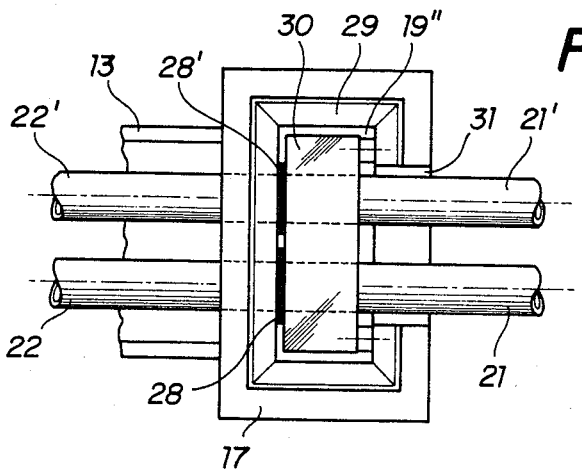
Figure 11:
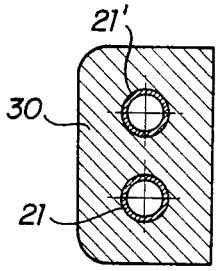

FIG. 5 is a top view of the cooling water coupling device 17, which shows that the ends 22 and 22' of the cooling water ducts lead into the openings 19 and/or 19. The seals 28 and 28' are located in undercuts of the cylindrical openings 19 and 19', said seals being driven back to their undercuts when the free ends 21 not shown in FIG. 5 are in the disengaged condition, thus without projecting into the cylindrical openings 19 and/or 19', in order to guarantee the smooth insertion of the free ends 21 into the openings 19.

Following the mode of illustration adopted for FIGS. 1 to 5, FIGS. 6 to 10 show a second embodiment of the invention. For the sake of simplicity, only those parts will be described in the following which differ from their eguivalent parts illustrated in FIGS. 1 to 5.

Figure 6:
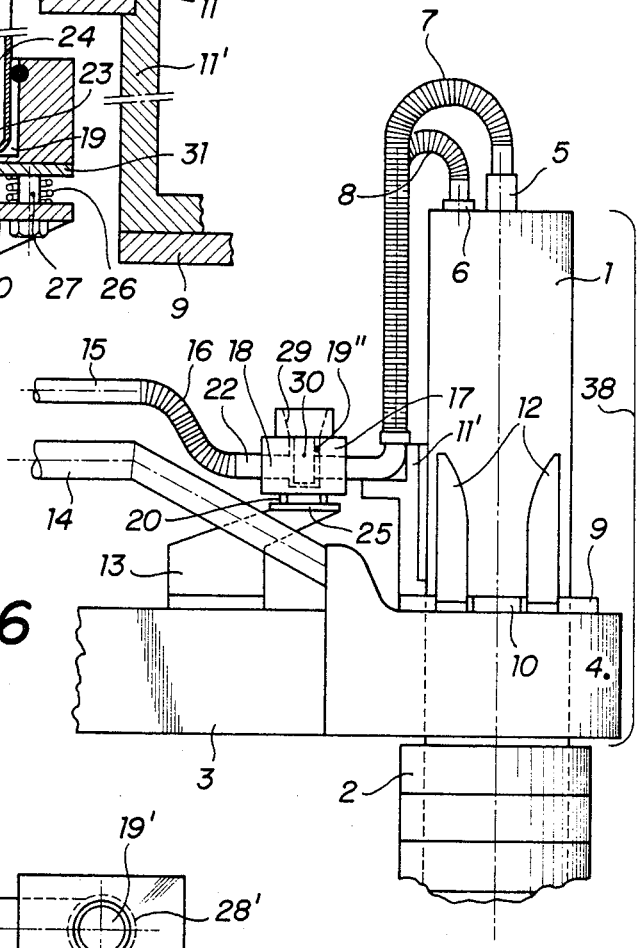
FIGS. 6 to 12 illustrate another embodiment of the invention.

In FIG. 1, the free ends 21 of the cooling water guides 7 and 8 enter the cooling water coupling device 17 parallel to the axis of the heat exchanger, while in FIG. 6 they enter the coupling device 17 in a direction leading radially away from the heat exchanger 1. However, this radial direction is not the coupling direction, as the coupling process here too is executed by slipping the electrode downwards through the electrode clamping device 4, which is also the case in FIGS. 1 to 5. FIGS. 7 to 10 show that the free ends 21 and/or 21' of the cooling water guides 7 and 8 are connected to a guide plate 30, which is illustrated in detail in FIG. 11, said rectangular plate 30, which is rounded off on two corners, being passed through by the two cooling water guides 21 and 21' running vertically to the plane of projection, with the free ends 21 and/or 21', however, not protruding beyond the guide plate 30, which is shown in FIGS. 7 to 10. The cooling water coupling device 17 has a rectangular opening 19'', which has approximately the same dimensions as the guide plate 30, with an insertion funnel 29 being located above the same, said funnel acting as a guide for the guide plate 30 when the free ends 21 are lowered.

Figure 12:
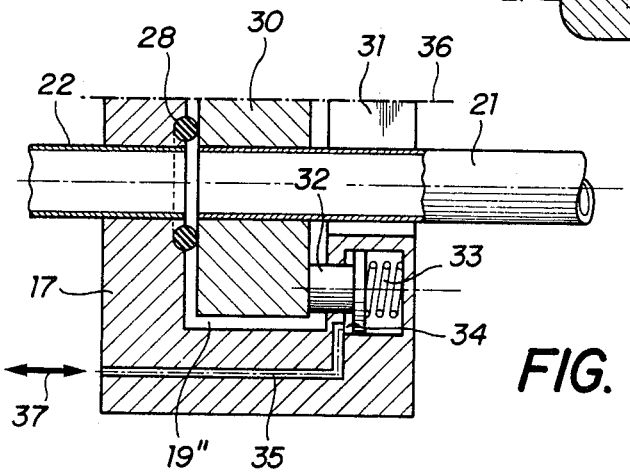

In the fully lowered condition of the guide plate 30 and, along with it, of the free ends, the guide plate 30 rests on the bottom plate 31 of the cooling water coupling device 17, the same being dimensioned in such a way that in this state the ends 22 and 21 are in alignment. On the side facing the heat exchanger 1 the cooling water coupling device is open in order to permit the lowering of the free ends 21 and/or 21' to the position illustrated in FIG. 9. The side wall of the opening 19'', which is passed through by the ends 22 and/or 22'. has concentric ring grooves around the ends 22 and/or 22', in which o'rings are located. By pressing the guide plate 30, these o'rings seal the cooling water passage from the end of the cooling water duct 22 to the free end 21 of the cooling water guide against the atmosphere. The guide plate 30 may be pressed e.g. by means of a hydraulic mechanism of the type shown in FIG. 12. FIG. 12 illustrates one half of the cooling water coupling device 17 which is symmetrical to the intersection line 36. Through the force of a spiral spring 33 the guide plate 30 inserted into the opening 19'' is pressed via a plunger 32 against the opposite inner wall of the cooling water coupling device, as a result of which the cooling water passage is sealed from one end of the pipe to the other by means of a sealing device 28. In order to release the guide plate 30 when the water connection is uncoupled, a hydraulic pressure agent is pumped via the pipe 35 into the expansion cavity 34, as a result of which the plunger 32 is moved against the force of the spiral spring 33, thereby completely withdrawing from the opening 19''. It is advantageous, if the force applied to press the guide plate against the inner wall of the cooling water coupling device 17, stems from a permanent source of power, such as the spiral spring 33, and if the hydraulic system is used only for a short release of the guide plate, and not vice versa, as it is in this way that a reliable seal of the cooling water passage is guaranteed, a seal which is not endangered by any defects in the hydraulic system.

The invention was explained on the basis of two embodiments, without limitation to the design details of the devices illustrated in the drawings. Thus, there are no restrictions as for the design of the cooling water coupling device. Suitable devices may be sealed by external control, such as shown in the Figures, but also devices which use the pressure of the cooling liguid for tightening the seals may be employed, thus providing an automatic sealing upon supply of the cooling medium.

Also, the arrangement of the water ducts are not restricted by the disclosed design, these ducts may be parallel, concentric or in any other orientation to each other. In special cases, it may be of advantage, to separate them from each other and to carry out the respective connections by separate coupling devices.

It is also not absolutely necessary to engage the part of the coupling device which is arranged on the ring flange therewith. It may be sufficient, to provide the ring flange or any other support with positioning means for the coupling device to allow proper insertion of the free ends of the water ducts, whereafter the entire coupling device may be separated from the flange.

I claim:

1. An improvement in the connections of cooling water ducts to a water-cooled arc furnace electrode comprising an essentially cylindrical heat exchanger and a consumable portion connected thereto, whereby said electrode may be held or axially moved in a clamping device arranged on an electrode support arm, said clamping device holding said electrode at a variable location along said heat exchanger, the improvement comprising:

movable water inlet and outlet conduits each connected at one end to said heat exchanger;

support means for said inlet and outlet conduits, said support means being axially and circumferentially movable along and about said heat exchanger;

a coupling device mounted on said electrode support arm and connected to cooling water supply and discharge conduits, and having openings for receiving unconnected ends of said inlet and outlet conduits; and guide means, mounted on said electrode support arm and cooperating with guide laps arranged on said support means, such that during positioning of said electrode by axial movement through said clamping device, unconnected ends of said inlet and outlet conduits are aligned with said coupling device before received therein.

2. The improvement of claim 1, wherein said support means is mounted on a ring flange which is movable about said heat exchanger.

3. The improvement of claim 2, wherein said ring flange abuts against said electrode clamping device contacting same around said heat exchanger.

4. The improvement of claim 1, wherein said unconnected ends of the inlet and outlet conduits depend downwardly along the axis of said heat exchanger.

5. The improvement of claim 1, wherein said coupling device is a metal block comprising said openings having inside diameter slightly enlarged over the outside diameter of said unconnected ends of said inlet and outlet conduits.

6. The improvement of claim 1, wherein said unconnected ends of said inlet and outlet conduits extend radially away from said heat exchanger and terminate in a guide plate with the coupling device having an opening for receiving said guide plate, said opening having dimensions essentially the same as those of said guide plate.

7. The improvement of claim 1, wherein said coupling device is mounted on said electrode support arm via shock absorbers.

8. The improvement of claim 5 or 6, wherein said openings have seal means for sealing said unconnected ends of the cooling water guides, when received within said openings, against the outside atmosphere.

9. The improvement of claim 8, wherein said seal means are operated hydraulically or pneumatically.

* * * * *